US006176051B1

(12) United States Patent
Sorkin

(10) Patent No.: US 6,176,051 B1
(45) Date of Patent: Jan. 23, 2001

(54) SPLICE CHUCK FOR USE IN A POST-TENSION ANCHOR SYSTEM

(76) Inventor: Felix L. Sorkin, 4115 Greenbriar Dr., P.O. Box 1503, Stafford, TX (US) 77477

( * ) Notice: Under 35 U.S.C. 154(b), the term of this patent shall be extended for 0 days.

(21) Appl. No.: 09/317,096

(22) Filed: May 23, 1999

Related U.S. Application Data

(63) Continuation-in-part of application No. 09/299,258, filed on Apr. 26, 1999.

(51) Int. Cl.[7] ..... E04C 5/08

(52) U.S. Cl. ..... 52/223.13; 52/223.11; 403/305; 403/374.1

(58) Field of Search ..... 52/223.1, 223.6, 52/223.11, 223.13, 223.14, 583.1, 726.1; 403/374.1, 305, 308

(56) References Cited

U.S. PATENT DOCUMENTS

| | | | | |
|---|---|---|---|---|
| 2,386,473 | * | 10/1945 | Kanary | 52/726.1 X |
| 3,378,891 | * | 4/1968 | Metz | 403/374.1 X |
| 3,967,421 | * | 7/1976 | Dufossez | 52/223.13 X |
| 4,680,906 | * | 7/1987 | Prevedini | 52/223.13 |
| 4,718,209 | * | 1/1988 | Hansen et al. | 52/223.13 |
| 4,724,639 | * | 2/1988 | Moser | 52/223.13 |
| 4,729,200 | * | 3/1988 | Brearley | 52/223.13 |
| 5,749,185 | | 5/1998 | Sorkin . | |
| 5,775,849 | | 7/1998 | Sorkin . | |

* cited by examiner

*Primary Examiner*—Beth A. Stephan
*Assistant Examiner*—Brian E. Glessner
(74) *Attorney, Agent, or Firm*—Harrison & Egbert

(57) ABSTRACT

A splice chuck having a body with a first end and a second end and a passage extending therethrough, a first collar received within the first end of the body and having a tapered interior, a second collar received within the second end of the body and having a tapered interior, a first wedge received within the tapered interior of the first collar, a second wedge received within the tapered interior of the second collar, a cap member having a surface abutting an end of the first wedge within the passageway of the body, and a resilient member having one end exerting a compressive force onto the second wedge and an opposite end exerting a compressive force onto the cap member. The cap member includes a tubular section having an interior area and an annular section extending radially outwardly from an end of the tubular section. A cover extends over the opposite end of the tubular section. The annular surface contacts an end of the first wedge. The interior area of the tubular section opens to the tapered interior of the first collar.

26 Claims, 3 Drawing Sheets

SPLICE CHUCK FOR USE IN A POST-TENSION ANCHOR SYSTEM

RELATED APPLICATION

The present invention is a continuation-in-part of U.S. application Ser. No. 09/299,258, filed on Apr. 26, 1999, and entitled "Intermediate Anchorage System Utilizing Splice Chuck", presently pending.

TECHNICAL FIELD

The present invention relates to post-tensioning systems. More particularly, the present invention relates to post-tensioning systems having intermediate anchorages. Furthermore, the present invention relates to sealing devices for preventing liquid intrusion into the exposed sections of tendon in the post-tension system.

BACKGROUND ART

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members.

Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

There are many post-tension systems employing intermediate anchorages where the length of the slab is too long to tension with a single anchor. In these systems, the intermediate anchor is interposed between a live end and a dead end anchor. In the construction of such intermediate anchorage systems, the tendon extends for a desired length to the intermediate anchor. A portion of the sheathing is removed in the vicinity of the intermediate anchor. The intermediate anchor is installed onto a form board in accordance with conventional practice. The unsheathed portion of the tendon is received by a tensioning apparatus such that the tendon is stressed in the area between the dead end anchor and the intermediate anchor. After- stressing the tendon, concrete is poured over the exterior of the sheathed tendon and over the dead end anchor and intermediate anchor. The remaining portion of the tendon extends from the intermediate anchor to either another intermediate anchorage or to the live end anchor. Intermediate anchorage systems are employed whenever the slab is so long that a single live anchor extending to a single dead end anchor is inadequate. For example, two intermediate anchorages would be used for slabs having a length of approximately 300 feet.

A problem that affects many of the intermediate anchorage systems is the inability to effectively prevent liquid intrusion into the unsheathed portion of the tendon. Normally, the unsheathed portion will extend outwardly, for a distance, from the intermediate anchor in the direction toward the dead end anchor. Additionally, another unsheathed portion will extend outwardly at the intermediate anchor toward the live end anchor. In normal practice with a single live anchor and without intermediate anchors, a liquid-tight tubular member is placed onto an end of the anchor so as to cover the unsheathed portion of the tendon. This is relatively easy to accomplish since the length of the tendon is minimal at the live end. However, it is a considerable burden to attempt to slide such a tubular member along the entire length of the tendon so as to form the liquid-tight seal at the intermediate anchorage. In normal practice, tape, or other corrosion protection materials, are applied to the exposed portion of the tendon adjacent the intermediate anchorage. Extensive practice with this technique has shown that it is generally ineffective for preventing liquid intrusion into the interior of the tendon or into the interior of the intermediate anchorage. As such, a great need has developed in which to protect the exposed areas of the tendon adjacent the intermediate anchorage.

A problem inherent in such continuous tendon intermediate anchorage systems is the difficulty of installation. Conventionally, in order to install the great lengths of tendon associated with such an intermediate anchorage systems, it is necessary for the worker at the construction site to thread the anchor along the length of the tendon so as to place the anchor in a desired position. Often during this "threading" of the anchor onto the tendon, nicks and damage can occur to the sheathing on the tendon. Often, components of the intermediate anchorage system are omitted or the installation is carried out in an ineffective manner because of the large amount of manual manipulation that is required for the installation of the system. Inherently, each of the intermediate anchors will be located in a joint of the concrete structure. As such, each of the anchors will be exposed to the corroding elements in this location. The liquid resistance of the intermediate anchorage system must be particularly good so as to prevent any damage to the exposed portions of the tendon.

In one form of the installation of post-tension systems, a "splice chuck" is used so as to secure the end of one tendon to the end of a next in-line tendon. Conventionally, the splice chuck will be joined to the unsheathed portion of a first tendon and joined to the unsheathed portion of a second tendon. The use of wedges, springs and other components of the splice chuck will assure that one end of the first tendon is securely joined to the opposite end of the next in-line tendon. After the splice chuck is used to join the ends of the tendons in proper relationship, the concrete can be poured over the tendons and the splice chuck. Unfortunately, because of the use of springs, wedges and other components in the splice chuck, the splice chuck is particularly susceptible of corrosion and deterioration. The weakening of any component within the splice chuck, such as the spring, can cause the integrity of the splice chuck to become compromised and, possibly, release the end of one tendon from the end of an adjoining tendon. The exposure of the splice chuck to the corroding elements is particularly important since, as stated previously, the intermediate anchorage will inherently appear at a joint in the concrete structure.

FIG. 1 illustrates the configuration of a conventional splice chuck as used for the joining of tendons 1 and 2 in end-to-end relationship. The splice chuck 3 includes a body 4 having an interior passageway 5. The body 4 has a generally tubular configuration with a threaded area 5A at one end and a threaded area 5B at an opposite end. A first collar 6 is received within the threaded end 5A of the body 4. Similarly, a collar 7 is threadedly received within the threaded area 5B of body 4. The collars 6 and 7 have tapered interiors 6A and 7A, respectively. Wedges 8A and 8B are received within the tapered interior 6A of collar 6. Similarly, wedges 8C and 8D are received within the tapered interior 7A of collar 7. A spring 9A is positioned within the interior 5 of the body 4 of the splice chuck 3. Spring 9A will reside against a surface of the cap 9B located on the interior 5 of the body 4. Spring 9A will exert a force onto the end of wedges 8C and 8D so as to urge the wedges 8C and 8D into the interior 7A of collar 7. Similarly, a spring 9C will be received within the interior of cap 9B so as to exert a force onto the end of wedges SA and 8B so as to urge the wedges 8A and 8B into the tapered interior 6A of collar 6.

As can be seen, the unsheathed portion of tendon 1 is received within the space between wedges 8C and 8D and within the interior tapered cavity 7A of the collar 7 at one end of the splice chuck 3. Similarly, an unsheathed portion of the second tendon 2 is received between the wedges 8A and 8B within the tapered interior cavity 6A of collar 6. When a tension force is exerted on either or both of the tendons 1 and 2, the respective wedges will be drawn into the respective tapered interior cavities of the respective collars so as to establish a strong interference fit relationship with the cavity and to securely engage the respective tendons therein. The use of the springs 9A and 9C assures that the unsheathed ends of the tendons 1 and 2 can be easily inserted into the respective open ends of the splice chuck 3.

The splice chuck can solve the problems associated with the extremely long strands or tendons throughout the concrete structure. In effect, shorter lengths of tendons can be installed and joined in secure end-to-end relationship by the use of a splice chuck. The anchors can be pre-installed onto the tendon prior to delivery to the construction site. The use of the splice chuck eliminates the need for workers to "thread" the anchor, and the other components, along the extended lengths (up to five hundred feet) of the tendon. Unfortunately, the splice chucks have not been able to be used as part of an intermediate anchorage system in which encapsulated systems are required.

A problem associated with the prior art splice chuck, as illustrated in FIG. 1, is that the splice chuck is completely unsealed to the ambient environment. As such, liquid intrusion can easily destroy the interior of the components of the splice chuck 3. Additionally, the arrangement of springs 9A and 9C, along with the cap 9B, greatly increases the required length of the body 4 of the splice chuck 3. Since the splice chuck 3 will displace concrete within the concrete structure, it is desirable to minimize the size of the splice chuck 3 as much as possible. Additionally, the strong steel components of the splice chuck 3 are relatively expensive. As such, it is desirable to minimize the amount of steel material used for the formation of the splice chuck 3. The use of the springs 9A and 9C, along with the cap 9B, do not create a self-centering effect within the interior 5 of the body 4. As such, the splice chuck, as used in the prior art and as described in FIG. 1, presents problems in actual use.

It is an object of the present invention to provide a post-tension anchorage system which effectively prevents the intrusion of corroding elements into the interior of the system.

It is another object of the present invention to provide a post-tension system which effectively prevents the exposure of the splice chuck to the corroding elements.

It is another object of the present invention to provide an intermediate anchorage for a post-tension anchor system which eliminates the need for extended lengths of tendon.

It is a further object of the present invention to provide a post-tension system which eliminates the need to "thread" the anchor along an extended length of tendon.

It is still a further object of the present invention to provide a post-tension system which is easy to install and easy to use.

It is a further object of the present invention to provide an intermediate anchorage system which reduces labor requirements for installation.

It is still another object of the present invention to provide an improved splice chuck which minimizes the amount of material required for the formation of the splice chuck.

It is another object of the present invention to provide a splice chuck which minimizes the amount of concrete displaced by the splice chuck.

It is still a further object of the present invention to provide an improved splice chuck which self centers the tendon within the interior of the splice chuck.

These and other objects and advantages of the present invention will become apparent from a reading of the attached specification and appended claims.

SUMMARY OF THE INVENTION

The present invention is an improved splice chuck for a post-tension anchor system comprising a body having a first end, a second end and a passageway extending therethrough, a first collar received within the first end of the body and having a tapered interior, a second collar received within the second end of the body and having a tapered interior, a first wedge received within the tapered interior of the first collar, a second wedge received within the tapered interior of the second collar, a cap member having a surface abutting an end of the first wedge within the passageway of the body, and a resilient member having one end exerting a compressive force onto the second wedge and an opposite end exerting a compressive force onto the cap member.

In the present invention, the cap member comprises a tubular section having an interior area and an annular section extending radially outwardly from an end of the tubular section. A cover extends over the interior area at an opposite end of the tubular section. The annular surface contacts an edge of the first wedge. The interior area of the tubular section opens to the tapered interior of the first collar.

In the present invention, the resilient member is a coil spring positioned within the passageway of the body. The coil spring has one end abutting an end of the second wedge so as to urge the second wedge into the tapered interior of the second collar. The coil spring has an opposite end abutting the annular surface of the cap member. The tubular section extends into an interior of the coil spring.

In the present invention, a cover extends over the body so as to prevent liquid from entering the passageway. The cover, in one form of the present invention, includes a polymeric encapsulation formed over an exterior surface of the body and having a cap-receiving receptacle formed at an end thereof beyond an end of the body, and a cap removably received within the cap-receiving receptacle. The cap has an opening at an end opposite the body. In an alternative form of the present invention, the cover comprises a polymeric section formed onto one end of the body and extending outwardly therefrom and an elastomeric section affixed over an opposite end of the body and arranged in liquid-tight relationship with the polymeric section. The elastomeric section extends beyond an end of the body.

The present invention is also a post-tension anchor system having the tendons as received within the ends of the splice chuck.

DETAILED DESCRIPTION OF THE PRESENT INVENTION

Figure 1:
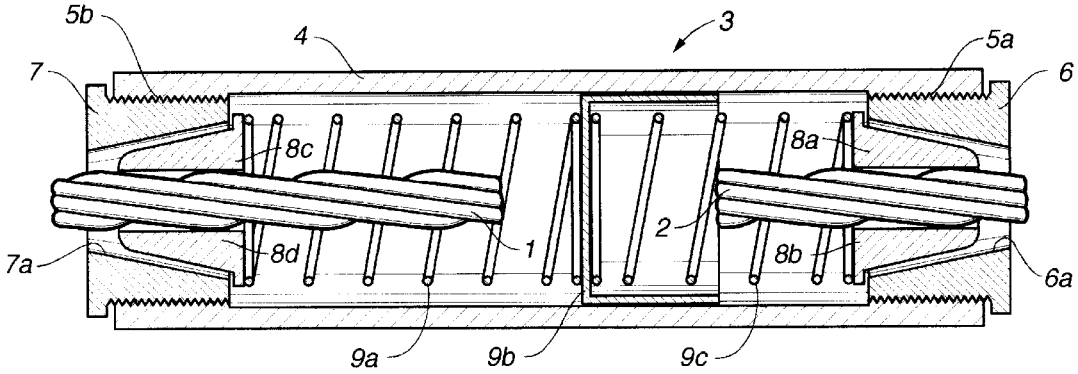
FIG. 1 Prior Art
FIG. 1 is a cross-sectional view of the prior art splice chuck.
Figure 2:
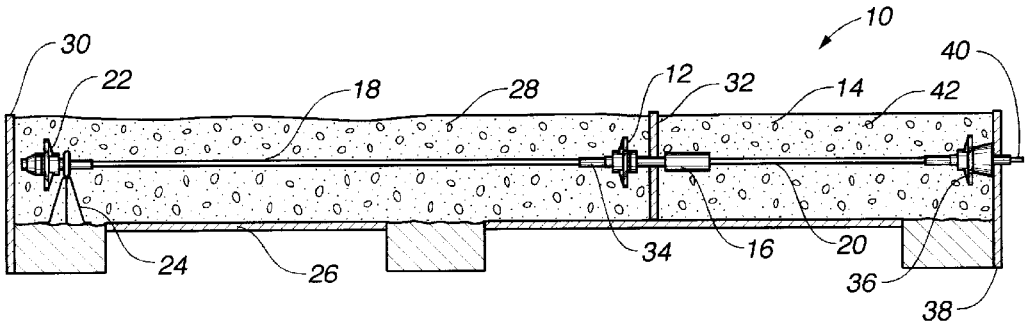
FIG. 2 is a diagrammatic illustration of the installation of the intermediate anchorage in accordance with the method of the present invention.

Referring to FIG. 2, there is shown at 10 a post-tension anchor system employing an intermediate anchorage 12 located within the interior of a concrete structure 14. The present invention is a method of installing the intermediate anchorage 12 through the use of a covered splice chuck 16 located adjacent to the intermediate anchorage 12 of the post-tension system 10. The post-tension system 10 illustrates the use of a first tendon 18 and a second tendon 20.

In the method of the present invention, a first anchor 22 is positioned on a support 24 extending above the floor 26. One end of the first tendon 18 is received within the anchor 22 and extends outwardly therefrom. The opposite end of the tendon 18 is received within the intermediate anchorage 12. Conventionally, a form board will be placed adjacent to the intermediate anchorage 12 so as to allow for the pouring of the concrete 28 in the area between the intermediate anchorage 12 and over the end of the dead end anchor 22. Eventually, the concrete 28 will be solidified in the area between the form board 30 and joint 32. An unsheathed portion of the first tendon 18 will extend through the interior of the anchor 12 and outwardly past the area of joint 32. The intermediate anchor 12 is encapsulated with a polymeric material. A plastic tubular member 34 extends from the anchor 12 over an unsheathed portion of the first tendon 18.

Once the concrete 28 has suitably solidified, the unsheathed portion of the first tendon 18 extending past the end of the anchor 12 can be suitably tensioned by an appropriate tensioning device. The tensioning device must act on the unsheathed portion of the first tendon 18 extending outwardly from the anchor 12. After the tensioning has been completed, the tendon 18 will reside within the concrete 28 in a tensioned condition.

So as to join the first tendon 18 to the second tendon 20 in end-to-end relationship, the unsheathed tensioned end of the first tendon 18 is cut and inserted into the splice chuck 16. Similarly, an unsheathed portion of the second tendon 20 will be inserted into an opposite end of the splice chuck 16. As will be described hereinafter, the splice chuck 16 includes a cover having a cap which is adapted for receipt within the adjacent end of the anchor 12. The cover will also extend over the sheathed portion of the second tendon in liquid-tight relationship therewith. The second tendon 18 can then extend from the intermediate anchor 12 to a third anchor 36. The third anchor 36 is secured to the form board 38. The unsheathed end 40 of the second tendon 20 extends outwardly of the form board 38 from the anchor 36. The concrete 42 is then poured into the area between the joint 32 and the form board 38 and allowed to solidify. Once the concrete 42 has solidified, the unsheathed end 40 of the second tendon 20 can be appropriately tensioned. As such, the present invention provides a method of forming an intermediate anchorage 12 which includes separate tendons 18 and 20 arranged in end-to-end relationship. It should also be noted that the unsheathed end 40 of the second tendon can also be joined in end-to-end relationship in the manner described hereinbefore in association with the intermediate anchorage 12 and the splice chuck 16 as such, an extended length of the post-tension system can be created by using the method of the present invention.

Figure 3:
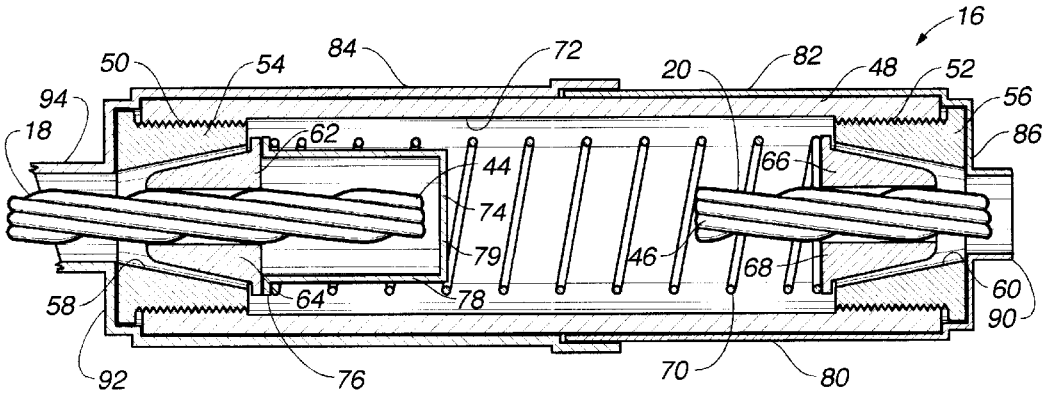
FIG. 3 is a cross-sectional view showing the splice chuck apparatus of the present invention.

FIG. 3 shows a splice chuck 16 which is used to receive the unsheathed end 44 of the first tendon 18 and the unsheathed end 46 of the second tendon 20. The splice chuck 16 has a body 48 of a generally conventional, but shortened, configuration. The body 48 has a generally tubular configuration with a threaded area 50 at one end and a threaded area 52 at an opposite end. A first collar 54 is received within the threaded end 50 of the body 48. Similarly, a collar 56 is threadedly received within the threaded end 52 of the body 48. The collars 54 and 56 have tapered interiors 58 and 60, respectively. Wedges 62 and 64 are received within the tapered interior 58 of collar 54. Similarly, wedges 66 and 68 are received within the tapered interior 60 of collar 56.

In the improved form of the present invention, a spring 70 is positioned within the interior passageway 72 of the body 48 of splice chuck 16. Spring 70 will reside against a surface of a cap 74 located on the interior 72 of body 48. Spring 70 will exert a compressive force onto the end of wedges 66 and 68 so as to urge the wedges 66 and 68 into the interior 60 of the collar 56. Similarly, spring 70 will exert a force onto the annular surface 76 of cap member 74 so as to, in turn, urge the wedges 62 and 64 into the tapered interior 58 of the collar 54.

It can be seen in FIG. 3 that the cap member 74 includes the annular surface 76 which abuts the ends of the wedges 62 and 64 within the interior passageway 72 of the body 48. The cap member 74 has a tubular section 78 extending outwardly from the annular section 76. The annular section 76 will extend outwardly radially from the tubular section 78. A cover 79 will extend over the interior area of the tubular section 78 at an end of the tubular section 78 opposite the annular surface 76.

In FIG. 3, it can be seen that the spring 70 is a resilient member. Spring 70 is a coil spring which has one end abutting the ends of the wedges 66 and 68 and an opposite end abutting the surface of the annular section 76 of cap member 74. Unlike the prior art, the present invention utilizes a single spring 70 within the interior 72. The unique cap member 74 will extend so that the unsheathed end 44 of the tendon 18 will extend into the interior area of the tubular section 78 of the cap member 74. The cover 79 will serve as a blocking member so as to prevent either of the unsheathed ends 44 and 46 of tendons 18 and 20, respectively, from interfering with the proper operation of the respective wedges, or for preventing the proper insertion of the respective tendons. By this arrangement of the spring and the cap member, the present invention eliminates the use of dual springs of the prior art and minimizes the length of the body 48 of the splice chuck 16. The tubular section 78 of the cap member 74 will act as a self-centering device for the unsheathed end 44 of the tendon 18. This interior area will tend to urge the unsheathed end 44 into a centralized location.

As can be seen, the unsheathed portion 44 of the first tendon 18 is received within the space within the wedges 62 and 64 and within the interior tapered cavity 58 of the collar 54 at one end of the splice chuck 48. Similarly, the unsheathed portion 46 of the second tendon 20 is received between the wedges 66 and 68 within the tapered interior cavity 60 of the collar 56. When a tension force is exerted on either or both of the tendons 18 and 20, the respective wedges will be drawn into the tapered interior cavities of the respective collars so as to establish a strong interference fit relationship with the cavity and to securely engage the respective tendons therein. The use of the spring 70, in combination with the cap member 74, assures that the unsheathed ends 44 and 46 of the tendons 18 and 20, respectively, can be easily inserted into the respective open ends of the splice chuck 16.

Figure 4:
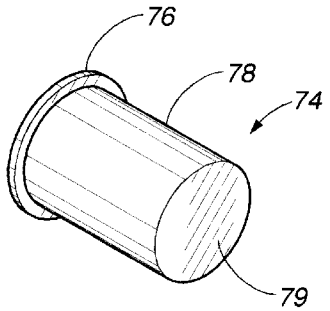
FIG. 4 is a perspective view showing the cap member as utilized within the splice chuck of the present invention.

FIG. 4 is an isolated view of the cap member 74. It can be seen that the cap member 74 includes an annular section 76 extending radially outwardly from the tubular section 78 at one end of the tubular section 78. The cover 79 extends over the opposite end of the tubular section 78 from the annular section 76. The hollow interior area of the tubular section 78 will serve to receive the unsheathed end 44 of the tendon 18 therein. The cap member 74 can be easily formed by injection molding of polymeric material.

Referring back to FIG. 3, it can be seen that a cover 80 extends over the body 48 of the splice chuck 16. The cover 80 includes a polymeric portion 82 and an elastomeric portion 84. The polymeric portion 82 extends over a portion of the body 48 and over end 86 of the splice chuck 16. The polymeric portion 82 can be suitably injection molded onto the exterior surface of the body 48. The polymeric portion 82 includes a neck area 90 which will extend in close relationship over the unsheathed portion of the tendon 20. A suitable cap can be connected to the neck portion 90 or other suitable liquid-sealing mechanisms incorporated therein. The polymeric portion 82 can either be injection molded directly onto the body 48 of the splice chuck 16 or can receive loosely the body of the splice chuck therein and be filled with grease so as to further establish strong liquid-resistant qualities on the interior of the polymeric portion 82.

The elastomeric portion 84 of cover 80 will overlap an end of the polymeric portion 82 and will extend along the remainder of the body 48 so as to extend downwardly over the end 92 of the body 84. The elastomeric portion 84 includes a narrowed area 94 at the end 92 of the body 48. This narrowed area 94 extends downwardly so as to be in liquid-tight engagement with a sheathed portion of the tendon 18. As such, liquid intrusion is effectively prevented from entering the splice chuck 16. The elastomeric portion 84 will overlap the polymeric portion 82 in liquid-tight engagement.

Figure 5:
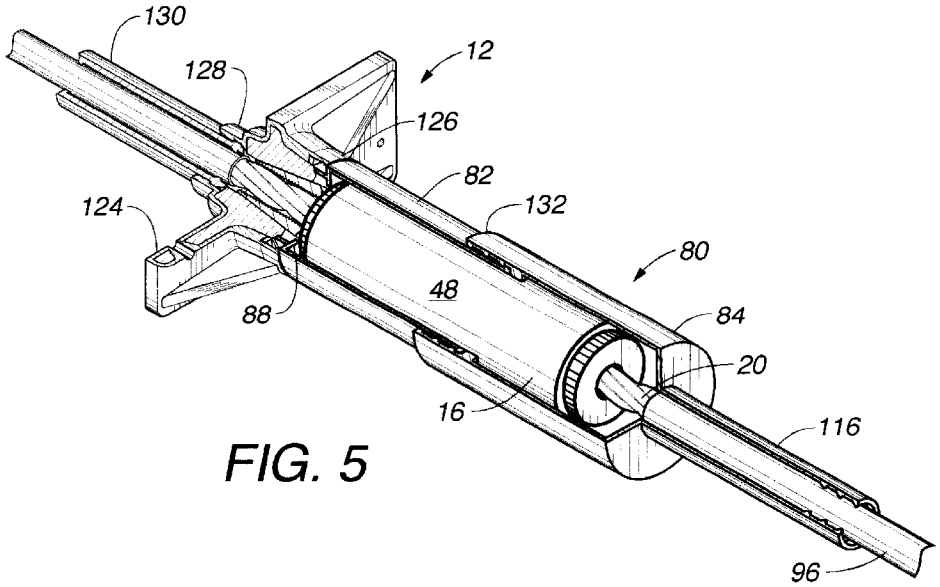
FIG. 5 is a perspective view, in partial cross section, showing the installation of the splice chuck onto the end of an anchor.

FIG. 5 illustrates the present invention as installed within the anchor 12. As can be seen in detail, the anchor 12 has an encapsulation 124 extending thereover. The anchor 12 includes a cap-receiving portion 126 formed of the polymeric encapsulation 124. A conventional steel anchor will be formed on the interior of the encapsulation 124. A tubular section 128 extends outwardly from one end of the encapsulation 124 associated with anchor 12. A tube 130 can be attached to this tubular section 128 in liquid-tight engagement therewith. Tube 130 will extend over an unsheathed portion of the tendon entering into the interior of the anchor 12.

In FIG. 5, it can be seen that the cap 88 will be received within the cap-receiving portion 126 of the encapsulation 124 of anchor 12. The elastomeric portion 84 will have an end 132 extending completely around and over the exterior of the polymeric portion 82 so as to establish a liquid-tight relationship therewith. The neck area 116 of the elastomeric portion 84 extends downwardly so as to establish a liquid-tight relationship with the sheathed portion 96 of the tendon 20. In this manner, the cover 80 effectively prevents liquid from intruding into the interior of the cover 80 and into the interior of the body 48 of the splice chuck 16.

By the use the present invention, an intermediate anchorage can be established by simply joining tendons in end-to-end relationship. Unlike the prior art, the present invention allows for long lengths of tendon to be connected in end-to-end relationship through the use of the splice chuck. However, the present invention retains the proper liquid-resistant qualities of the post-tension anchor system by covering the splice chuck so as to prevent liquid intrusion from occurring therewith. The splice chuck is suitably joined with the encapsulated anchor body so as to present a secure and sealed area over the exposed portions of the tendon received therein. The present invention only allows the sealed and sheathed portions of the tendon to emerge from the anchor body or from the splice chuck. As such, the present invention provides an encapsulated system for an intermediate anchorage.

Figure 6:
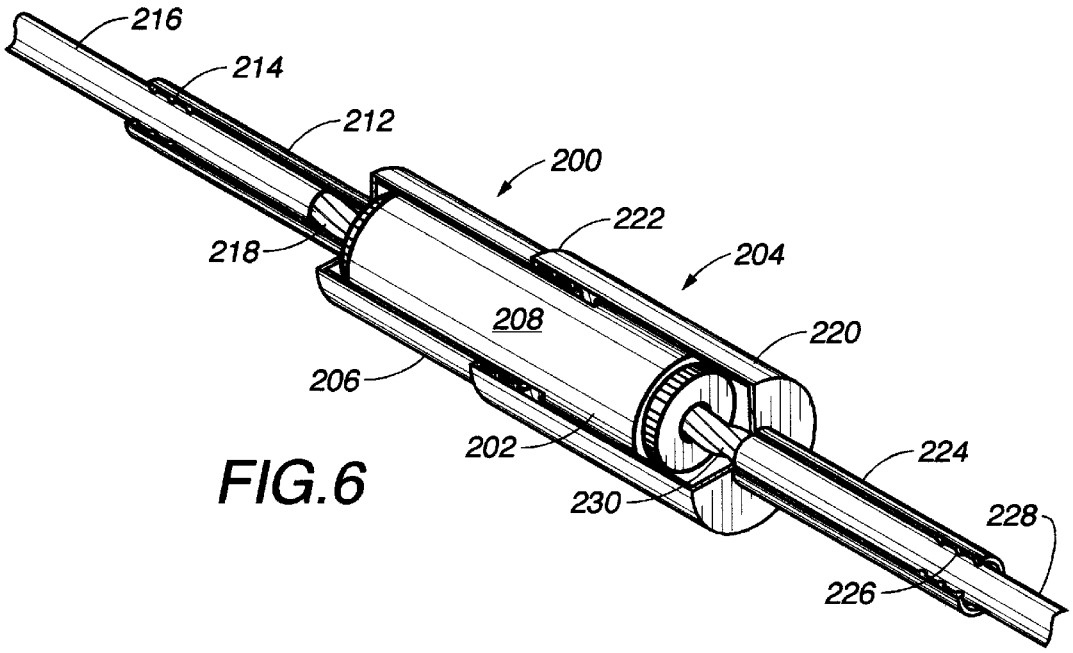
FIG. 6 is a perspective view, in partial cross section, showing the use of the splice chuck for joining ends of tendons together.

FIG. 6 shows an alternative embodiment 200 of the present invention. In the embodiment 200, it should be noted that the splice chuck 202 is of an identical configuration to that described herein previously. It is the cover 204 that differs between the prior preferred embodiment of the present invention and this alternative embodiment 200.

In the alternative embodiment 200, a first elastomeric portion 206 will extend over a portion of the body 208 of the splice chuck 202 and over the end 210 of the body 208. The first elastomeric portion 206 will have a neck area 212 of narrow diameter emerging from the end 210 of the splice chuck 202. This narrow neck portion 212 can have a sealing end 214 which is suitable for establishing a liquid-tight seal with the sheathing 216 associated with a tendon 218. Similarly, a second elastomeric portion 220 can reside in overlapping relationship at 222 with the first elastomeric portion 206. The second elastomeric portion 220 will extend over the remaining portion of the body 208 of splice chuck 202. The second elastomeric portion 222 will narrow to a neck portion 224 over the end 226 of the body 208. This neck portion 224 will include a sealing element 226 which will engage the exterior of the sheathing 228 of tendon 230 in liquid-tight relationship therewith. Grease 232 is inserted into the area between the exterior of the body 208 and the interior of the cover 204.

In the alternative embodiment 200, as shown in FIG. 6, it can be seen that how the splice chuck 202 can be used so as to join the unsheathed ends of tendons 218 and 230 together. As such, it can be seen that how the present invention can be used in place of conventional anchorages in post-tension construction and can be used for the repair of existing lengths of tendons. In FIG. 6, it can further be seen that it is possible, within the concept of the present invention, for the first elastomeric portion 206 and the second elastomeric portion 222 to be formed of a polymeric material in the manner described herein previously. It can be further seen in FIG. 6 that the splice chuck 202 can reside in a relatively "loose" relationship within the interior of the cover 204. Since the cover 204 includes sealing elements 214 and 226 at its ends, the splice chuck 202 does not have to be securely fitted within the cover 204. These can be optionally used so as to fill the voids within the interior of the cover 204.

In the embodiment 200 of the present invention, the splice chuck 202 can be appropriately used so as to join the ends of tendons 216 and 230 in end-to-end relationship. As such, the present invention can be used so as to connect portions of a post-tension system which may be damaged or severed. Furthermore, the present invention enhances the integrity of the splice chuck 202 by placing the cover around the exterior of the splice chuck and maintaining this cover in liquid-tight relationship with the connected tendons 216 and 230. Furthermore, this embodiment of the present invention allows the splice chuck 202 to be used as part of an intermediate anchorage system at any location along the extended length of the tendon. The present invention can be used in the event that shorter lengths of tendons are provided than those which are required at the construction site. The cover 204, as recited in this form of the present invention, is not particularly adapted for joining with an anchor of the post-tension anchor system.

Figure 7:
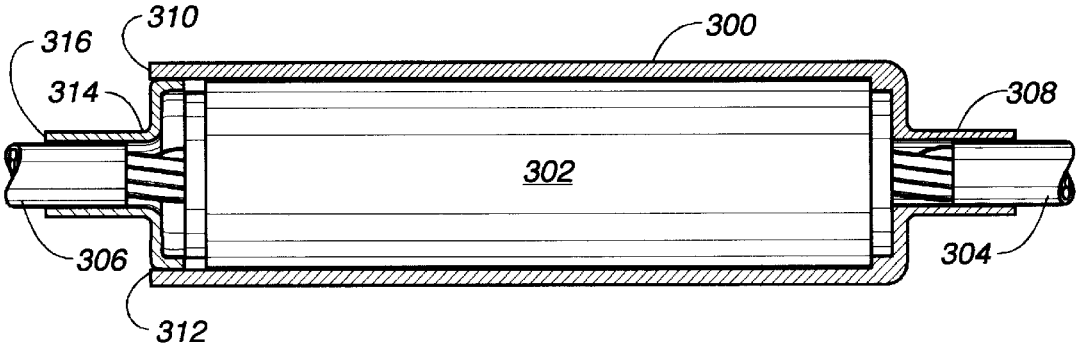
FIG. 7 is a cross-sectional view showing one form of the cover of the splice chuck in accordance with the present invention.

FIG. 7 illustrates another form of the present invention in which a cover 300 as applied over the splice chuck 302 (of the form described herein previously). Tendons 304 and 306 will extend into the splice chuck 302 in the matter described herein previously. In the embodiment of FIG. 7, the cover 300 is formed of a polymeric material so as to have a neck area 308 extending downwardly in close liquid-tight contact with the tendon 304. The opposite end 310 of the cover 300 will have a cap-receiving area 312 formed therein. A cap 314 is inserted within the cap-receiving area 312. Cap 314 can be attached within the cap-receiving area 312 in a snap-fit relationship. Cap 314 will have an open end 316 so as to allow tendon 306 to extend outwardly therefrom. Suitable sealants or sealing elements can be inserted within the opening 316 so as to establish a proper liquid-tight seal between the cap 314 and the splice chuck 302.

Figure 8:
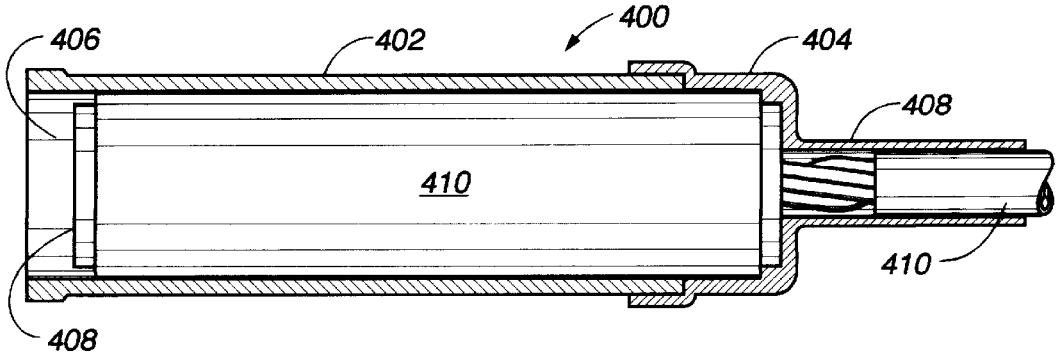
FIG. 8 is a cross-sectional view of another cover as used with the splice chuck of the present invention.

FIG. 8 shows another alternative embodiment similar to that shown in FIG. 7. In FIG. 8, it can be seen that the cover 400 includes a polymeric section 402 and an elastomeric section 404. The elastomeric section 404 overlies an end of the polymeric section 402 in liquid-tight engagement. A cap-receiving area is formed at the end of the polymeric section 402 opposite the elastomeric section 404. The elastomeric section 404 will extend downwardly so as to have a narrowed neck area 408 in tight liquid-tight relationship with a tendon 410. The cap-receiving area 406 is illustrated, without the cap attached, so as to be in a position suitable for sealing receipt of such a cap. The cap can be placed, in snap-fit relationship, within the cap-receiving area of the polymeric encapsulation 402. It can be seen that the cap-receiving area 406 extends outwardly beyond the end 408 of the splice chuck 410.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A splice chuck comprising:

a body having a first end and a second end, said body having a passageway extending therethrough;

a first collar received within said first end of said body, said first collar having a tapered interior;

a second collar received within said second end of said body, said second collar having a tapered interior;

a first wedge received within said tapered interior of said first collar;

a second wedge received within said tapered interior of said second collar;

a cap member having a surface abutting an end of said first wedge within said passageway of said body; and a resilient member having one end exerting a compressive force onto said second wedge and an opposite end exerting a compressive force onto said cap member.

2. The splice chuck of claim 1, said cap member comprising:

a tubular section having an interior area; and an annular section extending radially outwardly from an end of said tubular section.

3. The splice chuck of claim 2, further comprising:

a cover extending over said interior area of said tubular section at an opposite end of said tubular section.

4. The splice chuck of claim 2, said annular surface contacting an end of said first wedge, said interior area of said tubular section opening to said tapered interior of said first collar.

5. The splice chuck of claim 2, said resilient member comprising:

a coil spring positioned in said passageway of said body, said coil spring having said one end abutting an end of said second wedge so as to urge said second wedge into said tapered interior of said second collar, said coil spring having said opposite end abutting said annular surface of said cap member, said tubular section extending into an interior of said coil spring.

6. The splice chuck of claim 1, further comprising:

a cover extending over said body, said cover adapted to prevent liquid from entering said passageway.

7. The splice chuck of claim 6, said cover comprising:

a polymeric encapsulation formed over an exterior surface of said body, said polymeric encapsulation having a cap-receiving receptacle formed at an end extending beyond said body; and a cap removably received within said cap-receiving receptacle, and opening at an end opposite said body.

8. The splice chuck of claim 6, said cover comprising:

a polymeric section formed onto one end of said body and extending outwardly therefrom; and an elastomeric section affixed over an opposite end of said body and arranged in liquid-tight relationship with said polymeric section, said elastomeric section extending beyond an end of said body.

9. A post-tension anchor system comprising:

a first tendon;

a second tendon;

an anchor receiving said first tendon therein, said first tendon having an end extending outwardly of said anchor; and a splice chuck receiving said first tendon in one end thereof and said second tendon in an opposite end thereof, said splice chuck having a first wedge at said one end in compressive engagement with said first tendon, said splice chuck having a second wedge at said opposite end in compressive engagement with said second tendon, said splice chuck having a cap member with a surface abutting an end of said first wedge, said splice chuck having a resilient member exerting a compressive force onto said second wedge and a compressive force onto said cap member.

10. The system of claim 9, said cap member comprising:

a tubular section having an interior area; and an annular section extending radially outwardly from an end of said tubular section.

11. The system of claim 10, said cap member further comprising:

a cover extending over said interior area at said opposite end of said tubular section.

12. The system of claim 10, said annular surface contacting an end of said first wedge, said first tendon having an end extending into said tubular section.

13. The system of claim 10, said resilient member comprising:

a coil spring positioned within said splice chuck, said coil spring having one end abutting an end of said second wedge so as to urge said second wedge into the compressive engagement with said second tendon, said coil spring having an opposite end abutting said annular surface of said cap member, said tubular section of said cap member extending into an interior of said coil spring.

14. The system of claim 9, further comprising:

a cover extending over said splice chuck, said cover having one end in liquid-tight engagement with said first tendon, said cover having an opposite end in liquid-tight engagement with said second tendon.

15. The system of claim 14, said first tendon having a sheathed portion and an unsheathed portion, said second tendon having a sheathed portion and an unsheathed portion, said unsheathed portion of said first tendon received in said one end of said splice chuck, said one end of said cover being in liquid-tight engagement with said sheathed portion of said first tendon, said unsheathed portion of said second tendon received within said opposite end of said splice chuck, said opposite end of said cover being in liquid-tight engagement with said sheathed portion of said second tendon.

16. The system of claim 14, said second tendon having a sheathed portion and an unsheathed portion, said cover having said one end in liquid-tight engagement with said anchor, said cover having an opposite end in liquid-tight engagement with said sheathed portion of said second tendon.

17. The system of claim 14, said cover comprising:

a polymeric encapsulation formed over an exterior surface of said splice chuck, said polymeric encapsulation having a cap-receiving receptacle formed at an end extending beyond said splice chuck; and a cap removably received within said cap-receiving receptacle, said cap having an opening at an end opposite said splice chuck.

18. The system of claim 14, said cover comprising:

a polymeric section formed onto one end of said splice chuck and extending outwardly therefrom; and an elastomeric section affixed over an opposite end of said splice chuck and arranged in liquid-tight relationship with said polymeric section, said elastomeric section extending outwardly beyond an end of said splice chuck.

19. An improvement in a splice chuck having a body with a passageway extending therethrough, a first collar having a tapered interior and received within a first end of the body, a second collar having a tapered interior and received in a second end of the body, a first wedge received in the tapered interior of the first collar, a second wedge received within the tapered interior of the second collar, the improvement comprising:

a cap member having a surface abutting an end of said first wedge; and a resilient member having one end exerting a compressive force onto the second wedge and an opposite end exerting a compressive force onto said cap member.

20. The improvement of claim 19, said cap member comprising:

a tubular section having an interior area; and an annular section extending radially outwardly from an end of said tubular section.

21. The improvement of claim 20, said cap member further comprising:

a cover extending over said interior area at an opposite end of said tubular section.

22. The improvement of claim 20, said annular surface contacting an end of the first wedge, said interior area of said tubular section opening to the tapered interior of the first collar.

23. The improvement of claim 20, said resilient member comprising:

a coil spring positioned in the passageway of the body, said coil spring having one end abutting an end of the second wedge so as to urge the second wedge into the tapered interior of the second collar, said coil spring having said opposite end abutting said annular surface of said cap member, said tubular section extending into an interior of said coil spring.

24. The improvement of claim 19, further comprising:

a cover extending over the body, said cover being adapted to prevent liquid from entering the passageway of the body.

25. The improvement of claim 24, said cover comprising:

a polymeric encapsulation formed over an exterior surface of the body, said polymeric encapsulation having a cap-receiving receptacle formed at an end extending beyond the body; and a cap removably received within said cap-receiving receptacle, said cap having an open end at an end opposite the body.

26. The improvement of claim 24, said cover comprising:

a polymeric section formed onto one end of the body and extending outwardly therefrom; and an elastomeric section affixed over an opposite end of the body and arranged in liquid-tight relationship with the polymeric section, said elastomeric section extending beyond an end of the body.

* * * * *